US005286614A

United States Patent [19]

Ishizaki et al.

[11] Patent Number: 5,286,614

[45] Date of Patent: Feb. 15, 1994

[54] SUBSTRATE OF AND CORE FOR PHOTOSENSITIVE MATERIAL

[75] Inventors: Keiichi Ishizaki; Takashi Takeuchi; Mutsuo Akao; Hiroyuki Osanai; Shinichi Fujii, all of Kanagawa, Japan

[73] Assignee: Fuji Photo Film Co., Ltd., Minami-Ashigara, Japan

[21] Appl. No.: 835,585

[22] Filed: Feb. 14, 1992

[30] Foreign Application Priority Data

Feb. 15, 1991 [JP] Japan ..... 3-022265
Aug. 28, 1991 [JP] Japan ..... 3-217191

[51] Int. Cl.[5] ..... G03C 3/00

[52] U.S. Cl. ..... 430/501; 430/496; 430/934; 242/71; 242/71.1

[58] Field of Search ..... 430/496, 500, 501, 934; 242/71, 71.1

[56] References Cited

U.S. PATENT DOCUMENTS 3,515,558 6/1970 Winkler ..... 430/501
4,021,001 5/1977 Sproat ..... 428/34.2
4,697,757 10/1987 Nakaya et al. ..... 242/68.5
5,046,681 9/1991 Niedospial ..... 242/71.1

FOREIGN PATENT DOCUMENTS 1447576 12/1968 Fed. Rep. of Germany .
2617425 11/1976 Fed. Rep. of Germany .
8704557.5 9/1987 Fed. Rep. of Germany .
2-24116 7/1990 Japan .
1086148 10/1967 United Kingdom ..... 430/501
1146072 3/1969 United Kingdom .

OTHER PUBLICATIONS

Patent Abstracts of Japan vol. 12, No. 463, 6 Dec. 1988 & JPA 63184752.

*Primary Examiner*—Charles L. Bowers, Jr.
*Assistant Examiner*—Mark F. Huff
*Attorney, Agent, or Firm*—Burns, Doane, Swecker & Mathis

[57] ABSTRACT

A substrate of a photosensitive web material of which the base end portion is gradually thinned toward the base end a core for a rolled photographic film which comprises a core body and a crosslinked foamed sheet having an expansion ratio of 18 to 45 times and a thickness of 0.2 to 2.0 mm which contains more than 50 wt. % in the sum of one or more members selected from the group consisting of polyethylene resin having a density of less than 0.930 g/cm$^3$, ethylenevinyl acetate copolymer resin having a comonomer content of less than 25 wt. % and ethylene-ethyl arcylate copolymer resin having a comonomer content of less than 25 wt. % is disposed on the surface of the core body. The substrate and core sharply reduce the occurrence of marking troubles and pressure mark troubles on the photosensitive web material near the core caused by the difference in levels induced by the base end portion of the web.

12 Claims, 6 Drawing Sheets

FIG. 1
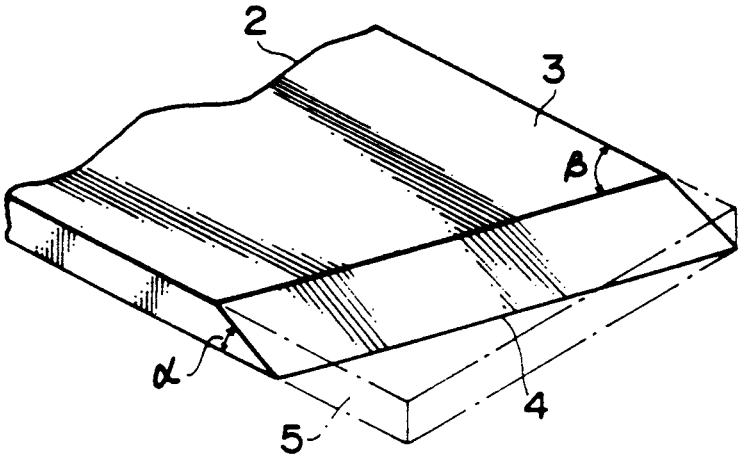
FIG. 2(a)
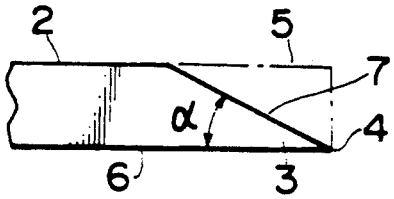
FIG. 2(b)
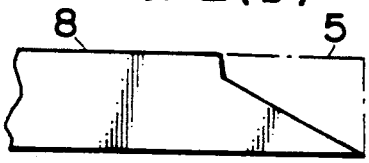
FIG. 2(c)
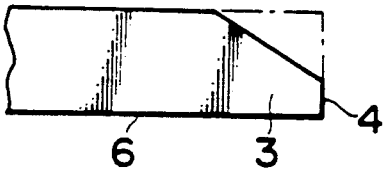
FIG. 2(d)
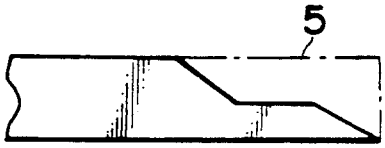
FIG. 2(e)
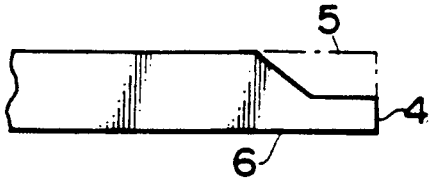
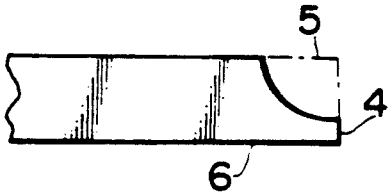
FIG. 2(f)

SUBSTRATE OF AND CORE FOR PHOTOSENSITIVE MATERIAL

BACKGROUND OF THE INVENTION

This invention relates to a substrate of a photosensitive web material and a core for a photosensitive web material which improves marking troubles of the photosensitive web material formed near the core.

The substrate base end of a conventional photosensitive web material is formed in almost a rectangular shape, both in the section and in the plane figure, as shown by dashed lines in FIG. 1. As a result, when conventional photosensitive web material is wound around a core, as shown in FIG. 13, a difference in level is formed between the base end 4 of the web 1 and the core 11 due to the thickness t of the web 1.

The conventional core for the photosensitive web is formed by winding in spiral a dense kraft paper, regenerated paper or the like. The core is rendered as hard as possible in order to prevent deformation of the core by the winding pressure of the photosensitive web, shocks encountered during physical distribution and the like, and therefore, its flattening compressive strength is high.

Since the photosensitive web is wound tight, creases 16 (FIG. 13), patterns and pressure marks are formed in several folds of the web near the core by the difference in levels at the base end portion of the web, the spiral groove on the surface of the core, etc. Moreover, in the case of fixing the base end of the photosensitive web using an adhesive, tape marks were also formed. These marks are formed during winding the photosensitive web and during preservation by the winding tension and its own weight.

The occurrence of these marks can be reduced to a certain degree by winding loosely. However, the loosely wound photosensitive web tends to project in a form of a cone by shaking during distribution, inclined state or the like. Moreover, wound form tends to be defective, and packaging defects also tend to be generated. As a result, workability is shaply decreased. An optimal roll density is determined by the thickness, length and friction coefficient of the photosensitive web, the flexibility and surface hardness of the substrate, temperature, humidity, distribution means, time and so on, and it is difficult to determine a suitable roll density.

A means for resolving the problem to form marks by the difference in level by the base end of the web is disclosed in Japanese Utility Model KOKAI Nos. 57-60141 and 63-41072 which forms a step portion 17 on the core corresponding to the thickness of the web in the axial direction, as shown in FIG. 12, and the web is begun to be wound from the step portion. This means has not been put to practical use, because it is not easy to adjust the base end of the web to the step portion under a dark safety light. The manufacture of the core is a special order, and the height of the step must be changed according to the thickness of the web. As a result, the manufacturing cost of the core is expensive.

Another means for resolving the problem is to form marks by the difference in level by the base end of the web as disclosed in Japanese Utility Model KOKAI No. 53-32021 wherein the base end of the web is cut obliquely in the plane figure. In this means, workability is improved, because the positioning of the base end of the web is easy. The occurrence of marking troubles is reduced to a certain degree, but the occurrence of pressure marks still remains due to the rectangular cutting in the thickness direction.

A means for resolving the problem due to the hardness of the core surface is disclosed in Japanese Utility Model KOKOKU No. 2-24116 which covers the circumferential face of the core in the whole width with a sheet having cushioning characteristics and elasticity, such as low density papers of less than 0.5 g/cm$^3$, synthetic papers and foamed resin sheet having an expansion ratio of 5 to 15 times. When the above core covered with the foamed resin sheet or the like is used as the core for a roll of photographic printing paper where a photographic emulsion layer is coated on a paper substrate or a water-resistant substrate made of paper of which both side are coated with various polyethylene resins, various physical marking troubles and pressure mark troubles can sharply be reduced. On the other hand, when the above core is used as the core for a roll of a photographic film of which the substrate is a plastic film having a less elasticity than the paper substrate, the marking troubles and pressure mark troubles occur in 5 to 6 revolutions of the film from the base end of the film. The Japanese Utility Model KOKOKU No. 2-24116 discloses a core provided with nonwoven fabric. In this core, since the friction resistance is small between the photographic film and the nonwoven fabric, it is necessary to fix the photographic film to the nonwoven fabric using an adhesive tape.

SUMMARY OF THE INVENTION

An object of the invention is to provide a means capable of decreasing sharply the physical marking troubles and pressure mark troubles of a photosensitive web material which is practical and which does not induce a loosening problem.

Another object of the invention is to provide a means capable of decreasing sharply the physical marking troubles and pressure mark troubles of a photosensitive web material which is not necessary to form a step portion on the core and of which the workability is excellent.

Another object of the invention is to provide a means capable of decreasing sharply the physical marking troubles and pressure mark troubles of a rolled photographic film.

The present invention provides, as a means which has achieved the above objects, a substrate of a photosensitive web material, a core for a photographic film and rolls of a photographic film.

The substrate of a photosensitive web material has the base end portion which is gradually thinned toward the base end.

The core for a rolled photographic film comprises a core body and a crosslinked foamed sheet having an expansion ratio of 18 to 45 times and a thickness of 0.2 to 2.0 mm which contains more than 50 wt. % in the sum of one or more members selected from the group consisting of polyethylene resin having a density of less than 0.930 g/cm$^3$, ethylenevinyl acetate copolymer resin having a comonomer content of less than 25 wt. % and ethylene-ethyl acrylate copolymer resin having a comonomer content of less than 25 wt. %, said foamed sheet being disposed on the surface of the core body.

One of the rolls of a photographic film comprises the above core and a rolled photographic film of which the substrate is made of plastic having a heat resistance of more than 250° F. and a strength of more than 7,000 psi.

Another roll of a photographic film comprises a core body, a cushioning material which is a member selected from the group consisting of paper, synthetic paper and nonwoven fabric having a density of less than 0.5 g/cm$^3$, foamed polyolefin sheet having an expansion ratio of 5 to 45 times disposed on the surface of the core body, and a rolled photographic film of which the base end portion is gradually thinned toward the base end wound around the cushioning material.

Still another roll of a photographic film comprises a core body, a cushioning material which is a member selected from the group consisting of paper, synthetic paper and nonwoven fabric having a density of less than 0.5 g/cm$^3$, and foamed polyolefin sheet having an expansion ratio of 5 to 45 times disposed on the surface of the core body, and a rolled photographic film of which the length of the base end is longer than the width of the photographic film.

BRIEF DESCRIPTION OF THE DRAWINGS

FIG. 1 is a perspective view illustrating the base end portion of the substrate of a photosensitive web material embodying the invention.

FIGS. 2 and 3 are sectional views illustrating various thinned forms of the base end portion applicable to the invention.

DETAILED DESCRIPTION OF THE INVENTION

The substrate of a photosensitive web material is made of polyester, polycarbonate, cellulose triacetate, cellulose diacetate, cellulose butylacetate, polystyrene, polypropylene, polyethylene terephthalate, cellulose nitrate, polyvinyl chloride, synthetic paper, thermoplastic resin coated paper, etc.

The rolled photographic film is composed of a silver halide photographic photosensitive material emulsion layer and a plastic film substrate coated therewith, and includes films for printing (lithfilm), films for roentgenograms, films for computerized type-setting systems, microfilms, positive films (such as Fuji Crystal Paper), and the like. The plastic film substrate is formed of polyester, polycarbonate, cellulose triacetate, polystyrene, polypropylene or the like, and it may be nonstretched, uniaxially stretched or biaxially stretched, and clear or colored with white or color pigment. Moreover, it may be metallized by deposition, sputtering, etc. A plastic film suitable for the core covered with the crosslinked foamed sheet has a heat resistance (ASTM D-759) of more than 250° F. and a strength (ASTM D-882) of more than 7,000 psi.

Figure 3:
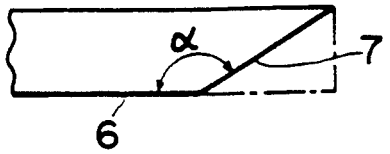

The substrate of the photosensitive web material is gradually thinned at the base end portion toward the base end, i.e. the end to start winding. The length in the longitudinal direction of the base end portion to be thinned is usually 0.1 to 10 times, particularly 0.5 to 5 times, the thickness of the substrate. A typical form is oblique as shown in FIG. 2(*a*), and a suitable angle $\alpha$ between the reverse face of the substrate 2 and the line oblique face 7 is 10 to 80 degrees, preferably 20 to 50 degrees, or as shown in FIG. 3, 100 to 170 degrees, preferably 130 to 160 degrees. It is difficult to manufacture the oblique face having an angle of less than 10 degrees or more than 170 degrees, and in an angle of 80 to 100 degrees, marks and pressure marks are liable to occur. The thinning form may be discontinuous, such as stepwise, as well as continuous.

Several other forms of gradually thinned base and portions are illustrated in FIG. 2(*b*) through (*f*) which are applicable to the invention. In the form of FIG. 2(*b*), the cut off portion 5 vertically descends from the upper face 8 and then is obliquely cut. In the form of FIG. 2(*c*), the base end portion 3 is obliquely cut, but the vertical base end 4 partially remains on the reverse face 6 side. In the form of FIG. 2(*d*), the cut off portion 5 is cut obliquely, then horizontally and obliquely again. In the form of FIG. 2(*e*), the cut off portion 5 is cut obliquely and then horizontally to leave a partial vertical base and 4 on the reverse face 6 side. In the form of FIG. 2(*f*), the cut off portion 5 is almost a quarter cylinder to leave a partial vertical base end 4 on the reverse face 6 side. These forms may be reversed like FIG. 3.

The length of the base end is preferably rendered longer than the width of the substrate, in order to prevent the occurrence of marking troubles and pressure mark troubles. A suitable length is 1.01 to 5.00 times the width of the substrate, and 1.02 to 2.00 times is preferred. A typical form is obliquely cut in the plane figure as shown in FIG. 4(*a*) and (*b*) and a suitable angle $\beta$ between a side end 9 and the base end 4 is 30 to 80 degrees.

Several other base end forms are illustrated in FIG. 4(*c*) through (*p*) which are applicable to the invention. In the form of FIG. 4(*c*), the base end portion 3 is obliquely cut from both side ends 9,9 toward the center of the base end 4 to form an equilateral triangle projection. In the form of FIG. 4(*d*), the base end portion 3 is obliquely cut from both corners 10,10 toward the inside of the substrate to form an equilateral triangle recess. In the form of FIG. 4(*e*), the base end portion is obliquely cut from both side ends at a different angle to form a non-equilateral triangle projection. In the form of FIG. 4(*f*), both corners 10,10 are cut at a different angle to form a trapezoidal projection. In the form of FIG. 4(*g*), the base end portion is cut to form a circular projection. In the form of FIG. 4(*h*), the base end portion is cut to form a circular recess. In the form of FIG. 4(*i*), both corners are cut to form round corners. In the form of FIG. 4(*j*) and (*k*), the base end portion is cut in a serrated fashion to form uniformly equilateral triangle projections. In the form of FIG. 4(*l*), the triangular serrated projections are ununiform. In the form of FIG. 4(*m*), the triangular serrated projections are cut obliquely as a whole. In the form of FIG. 4(*n*), the base end portion is cut to form several half circular projections having the same size. In the form of FIG. 4(*o*), the base end portion is cut to form several half circular recesses having the same size. In the form of FIG. 4(*p*), the half circular projections are arranged obliquely as a whole. Preferred forms are oblique cut as shown in FIG. 4(*a*) and (*b*), serrated cuts as shown in FIG. 4(*j*) through (*m*), a plurality of circular projections as shown in FIG. 4(*n*) and (*p*), and so on.

By thinning gradually the base end portion of the substrate of a photosensitive web material, the stress concentrated on the difference in level portion can be distributed to the oblique face, and as a result, the occurrence of marking troubles and pressure mark troubles are prevented. By lengthening the length of the base end, the dispersion of the stress is further achieved, and the marking troubles and pressure mark troubles can further be reduced. These means are inexpensive, and workability is not degraded.

The core for a rolled photographic film comprises a crosslinked foamed sheet and a core body.

The crosslinked foamed sheet prevents the occurrence of various marking and pressure marks on the photographic film wound around the core by its elasticity, and contains at least one of polyethylene resin having a density of less than 0.930 g/cm$^3$, ethylene-vinyl acetate (EVA) copolymer resin having a comonomer content of less than 25 wt. % and ethylene-ethyl acrylate (EEA) copolymer resin having a comonomer content of less than 25 wt. % in an amount of more than 50 wt. % in the sum of the above resin. When the amount is less than 50 wt. %, it is difficult to manufacture a foamed sheet having an expansion ratio of 18 times or more. The foamed sheet is insufficient in the cushionability and great in slipping characteristics. As a result, the winding of a photographic film is difficult, unless the base end is fixed to the core by an adhesive tape or an adhesive agent, and various marking troubles and pressure mark troubles tend to occur on the rolled photographic film.

The polyethylene resin may be selected form various high pressure branched low density homopolyethylene (LDPE) resins, linear low density polyethylene (L-LDPE) resins which are ethylene-α-olefin copolymer resins and blends of them. The L-LDPE resin is called the third polyethylene resin, and it is a low cost high strength resin having the advantages of both medium, low density polyethylene resin and high density polyethylene resin and meeting the requirements of the times of saving energy and resources. The L-LDPE resin is a copolymer produced by copolymerizing ethylene with an α-olefin having a number of carbon atoms of 3 to 13, preferably 4 to 10, through the low pressure process or the modified high pressure process, and has a linear structure with short branches. Preferred α-olefins in view of physical strength and cost are butene-1, heptene-1, hexene-1, 4-methylpentene-1, octene-1 and the like. As the polymerization process of L-LDPE, there are the vapor phase process and the liquid phase process using a medium, low pressure apparatus and the ionic polymerization process using an apparatus for the modified high pressure process. The density of polyethylene resin is less than 0.930 g/cm$^3$, preferably 0.90 to 0.92 g/cm$^3$, more preferably 0.910 to 0.925 g/cm$^3$. When the density exceeds 0.930 g/cm$^3$, it is difficult to manufacture a foamed sheet having an expansion ratio of 18 times or more. The foamed sheet is insufficient in cushionability and has large slipping characteristics. As a result, the winding of a photographic film is difficult, unless the base end is fixed to the core by an adhesive tape or an adhesive agent, and various marking troubles and pressure mark troubles tend to occur on the rolled photographic film.

The EVA resin having a comonomer content of less than 25 wt. % does not affect adversely photographic films, such as fogging or sensitivity deviation, and acetic acid odor is small.

The EEA resin having a comonomer content of less than 25 wt. % does not affect adversely photographic films, such as fogging or sensitivity deviation, and acrylic acid odor, apple-like odor, is weak and does not give discomfort to users.

When the comonomer content exceeds 25 wt. %, the EVA resin and the EEA resin adversely affects photographic films, such as fogging or sensitivity deviation. Acetic acid odor or acrylic acid odor becomes strong and gives discomfort to users.

The malt index (MI) of the above polyethylene resin, EVA resin and EEA resin is preferably less than 20 g/10 minutes, preferably 0.1 to 15 g/10 minutes, more preferably 0.5 to 10 g/10 minutes. When the MI exceeds 20 g/10 minutes, moldability is occasionally inferior.

Blowing agents applicable to manufacturing the crosslinked foamed sheet are sodium hydrogen carbonate, azido compounds such as $CaN_6$ and $BaN_6$, light metals reacting with water to generate hydrogen gas such as Mg, Zn and Al, azo compounds such as azodicarbonamide and azobisisobutyronitrile, sulfonyl hydrazide compounds such as p-toluenesulfonyl hydrazide, volatile organic blowing agents of halogenated hydrocarbons and mixtures thereof such as various mixtures of dichlorotetrafluoroethane with another halogenated hydrocarbon, e.g. trichloromonofluoromethane, methylene chloride, trichlorotrifluoroethane, dichloromonofluoromethane or dichlorofluoromethane, and so on. Undesirable blowing agents are heat-decomposable blowing agents of which a principal component is an ammonium compound, a formalin compound or a sulfur compound, because they adversely affect photographic films, such as by causing fogging or sensitivity deviation. Preferred blowing agents are those generating gas harmless to photographic films, such as $N_2$ or carbon dioxide gas, which include azodicarbonamide and N,N'-dinitrosopentamethylenetetramine and 4,4'-hydroxybenzenesulfonyl hydrazide, mixtures of halogenated hydrocarbons which are volatile organic blowing agent, and the like.

The crosslinking method may be chemical crosslinking or radiation crosslinking and the foamed sheet has an expansion ratio of 18 to 45 times, preferably 20 to 40 times, more preferably 25 to 35 times. When the expansion ratio is less than 18 times, marking troubles are liable to occur due to insufficient cushionability. When the expansion ratio exceeds 45 times, it is difficult to ensure wear resistance, surface strength, physical strength and productivity.

The thickness of the crosslinked foamed sheet is 0.2 to 2,0 mm, preferably 0.3 to 1.5 mm, more preferably 0.45 to 1.2 mm, in view of ensuring various properties and productivity.

The crosslinked foamed sheet is attached to the core body in spiral (with spaces), the whole circumferential surface, stripes, or the like. The attached area is more than 70% of the whole circumferential area.

The core body may be a conventional core, such as a core produced by winding a dense kraft paper or regenerated paper in spiral, a core produced by winding a cardboard in spiral on a mandrel and then winding a surface layer sheet in spiral thereon, a core made of plastic, a core made of metal, and any other known cores. Moreover, cores for taking up a web disclosed in Japanese Utility Model KOKOKU No. 3-28053 can also be applicable to the invention which have a mouthpiece portion, i.e. a contact portion with chucking apparatus which takes up a substrate used for manufacturing a photographic film or a photographic film manufactured by coating a photosensitive layer of silver halide emulsion or the like onto the substrate.

The physical marking troubles and pressure mark troubles can also be removed by a combination of the aforementioned photographic film of which the base end portion is gradually thinned or the length of the base end is longer than the width of the photographic film with a cushioning material which is paper, synthetic paper or nonwoven fabric having a density of less than 0.5 g/cm$^3$, or foamed polyolefin sheet having an expansion ratio of 5 to 45 times disposed on the surface of the aforementioned core body.

The paper having a density of less than 0.5 g/cm$^3$ measured by JIS P-8118 is made so as not to add a pressure to the paper through the paper making process and the finishing process or so as to select the kind of pulp, the length of pulp, the thickness of pulp, additives, etc. When the density exceeds 0.5 g/cm$^3$, various marking troubles and pressure mark troubles tend to occur, even if the base end portion of the photographic film is gradually thinned or the length of the base end is longer than the width.

As the synthetic paper, there are film synthetic papers produced by the internal paperizing method, film synthetic papers produced by the surface coating method, fiber synthetic papers produced by the spinbonding method and fiber synthetic papers produced by the synthetic pulp method. Among these synthetic papers, only those having a density of less than 0.5 g/cm$^3$ can avoid the occurrence of various marking troubles and pressure mark troubles in a combination with the photographic film of which the base end portion is gradually thinned or the length of the base end is longer than the width.

The nonwoven fabric can be divided into paper type nonwoven fabrics, felt type nonwoven fabrics, batting type nonwoven fabrics, wadding type nonwoven fabrics, punched type nonwoven fabrics, fabric type nonwoven fabrics, combination type nonwoven fabrics, and the like. Among these, only those having a density of less than 0.5 g/cm$^3$ can avoid the occurrence of various marking troubles and pressure mark troubles in a combination with the photographic film of which the base end portion is gradually thinned or the length of the base end is longer than the width.

The foamed polyolefin resin sheet having an expansion ratio of 5 to 45 times is produced using a polyolefin resin which does not affect adversely photographic photosensitive materials. Such a polyolefin resin includes low, medium, high density homopolyethylne resins, very low density polyethylene resins, ethylene-$\alpha$-olefin copolymer resins, homopolypropylene resins, propylene-$\alpha$-olefin copolymer resins, ethylene-vinyl acetate copolymer resins, ethylene-ethyl acrylate copolymer resins, ethylene-acrylic acid copolymer resins, ionomer resins, adhesive polyolefin resins (acid-modified polyolefin resins), ethylene-propylene copolymer resins, ethylene-butadiene copolymer resins, ethylene-propylene elastomers, ethylene-methyl arcylate copolymer resins, ethylene-vinyl chloride copolymer resins, ethylene-propylene-butene-1 ternary copolymer resins and the like. In the case that the expansion ratio is more than 18 times, in order to ensure the film strength at a high expansion state, suitable resin sheets are those aforementioned that are produced by crosslinking a polyolefin resin containing at least one of polyethylene resin having a density of less than 0.930 g/cm$^3$, EVA resin having a comonomer content of less than 25 wt. % and EEA resin having a comonomer content of less than 25 wt. % in an amount of more than 50 wt. % in the sum of the above resins. When the expansion ratio is less than 5 times, various marking troubles and pressure mark troubles tend to occur, even if the base end portion of the photographic film is gradually thinned or the length of the base end is longer the width. When the expansion ratio exceeds 45 times, wear resistance, surface strength, etc. are degraded. Moreover, compression deformation is too great, and therefore, the core cannot be put to practical use.

In the core for a rolled photographic film of the invention, the crosslinked foamed sheet sinks elastically to prevent the occurrence of physical marking troubles, pressure mark troubles and sensitivity deviation troubles.

EXAMPLES

Examples I–IV, Comparative Examples A and B

Figure 5:
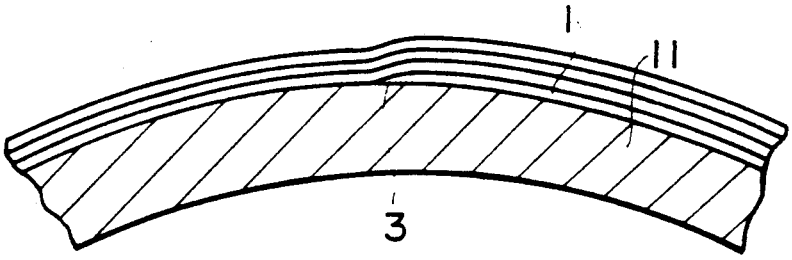
FIG. 5 is a partial sectional view illustrating a wound state of a photosensitive web material in which the base end portion is gradually thinned around a core.

A positive color photographic photosensitive emulsion for movie was uniformly coated onto a cellulose triacetate web 135 $\mu$m in thickness. The base end portion of the web was processed into each form, as shown in FIG. 1 and details are described in Table 1, and the positive color photographic film for movie 110 cm in width 4000 m in length was wound around a core 40 cm in diameter made of a synthetic resin at a winding tension of 70 kg/m width. The wound state is shown in FIG. 5. As shown in the figure, the photographic film 1 was smoothly wound around the core 11 even at the base end portion 3.

Each film was developed, and pressure marks was determined by visual observation using transmitted light. That is, the number of folds of the film was inspected on which a linear concentrated portion appeared resulting in a quality unsuitable for the use of a positive color photographic film for movie. A smaller value indicates less occurrence of pressure marks.

TABLE 1

Figure 4A:
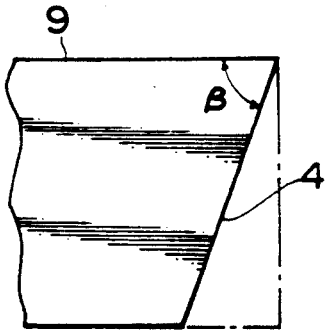
FIG. 4 indicates plan views of various forms of the base end portion of which the length of the base end is longer than the width of the web material.
Figure 4D:
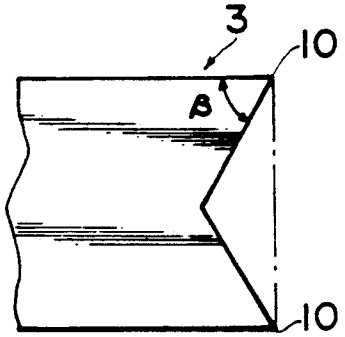
Figure 4B:
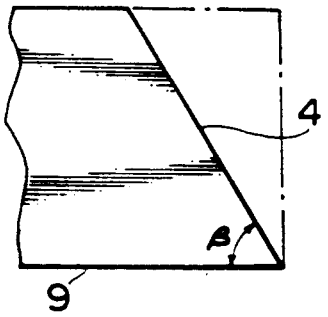
Figure 4E:
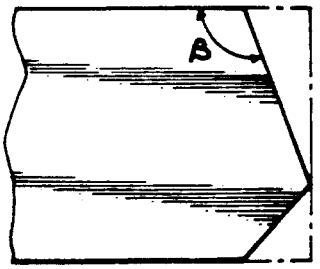
Figure 4C:
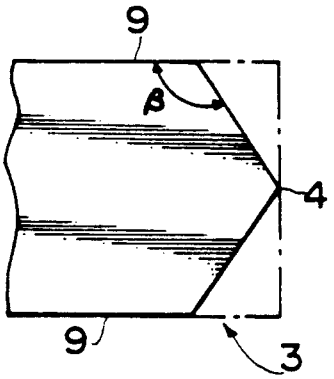
Figure 4F:
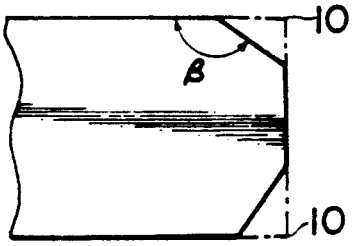

| | Angle $\alpha$ (Degrees) | Angle $\beta$ (Degrees) | Pressure Marks (Round) | End Form in Thickness Direction | End Form in width Direction |
|---|---|---|---|---|---|
| Example I | 30 | 90 | 6 | FIG. 2(a) (full line) | FIG. 4(a) (broken line) |
| Example II | 30 | 75 | 1 | " | FIG. 4(a) (full line) |
| Example III | 60 | 75 | 3 | " | " |

TABLE 1-continued

Figure 4G:
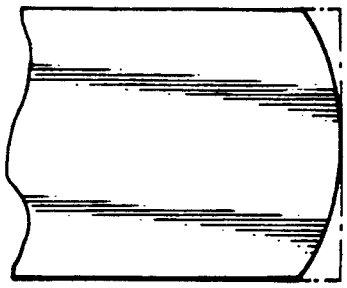
Figure 4K:
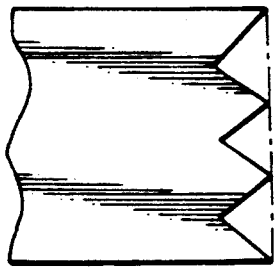
Figure 4H:
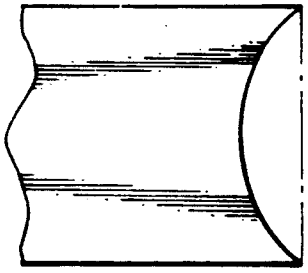
Figure 4L:
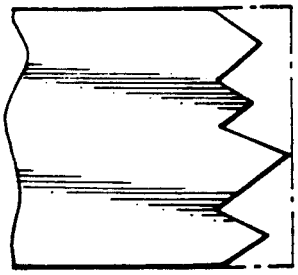
Figure 4I:
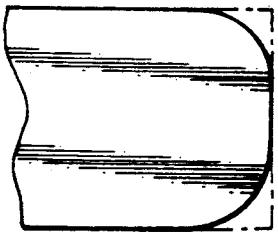
Figure 4M:
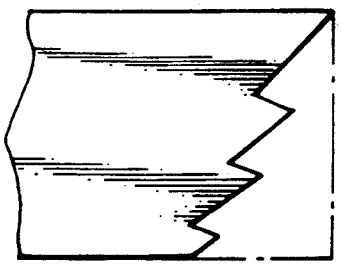
Figure 4J:
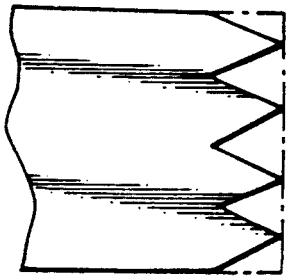
Figure 4N:
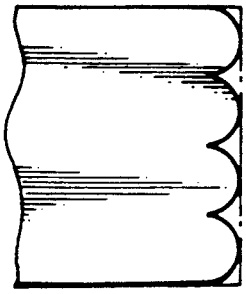
Figure 4O:
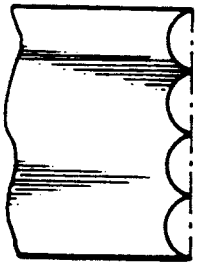
Figure 4P:
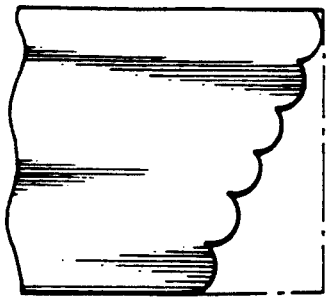

| | Angle α (Degrees) | Angle β (Degrees) | Pressure Marks (Round) | End Form in Thickness Direction | End Form in width Direction |
|---|---|---|---|---|---|
| Example IV | 30 | 45 | 1 | " | " |
| Example V | 45 | 45 | 2 | " | " |
| Example VI | 30 | Arc | 1 | " | FIG. 4(g) (full line) |
| Comparative A | 90 | 90 | 20 | FIG. 2(a) (dashed line) | FIG. 4(a) (broken line) |
| Comparative B | 90 | 75 | 14 | " | FIG. 4(a) (full line) |

Example VII

Figure 6:
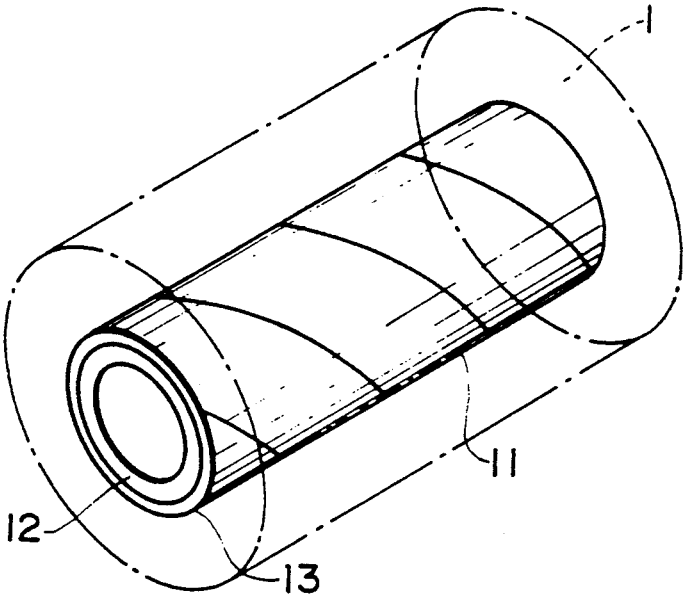
FIG. 6 is a perspective view illustrating a roll of a photographic film wound around a core comprising the core body and the crosslinked foamed sheet.
Figure 7:
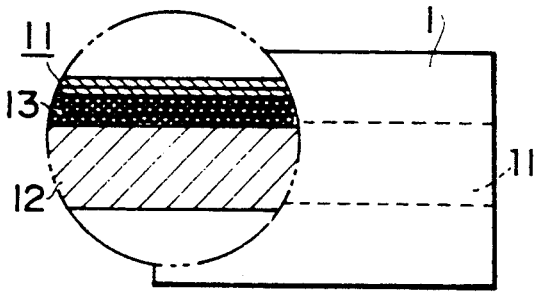
FIG. 7 is a side view with a partially enlarged section.

An example of the roll of a photographic film of the invention is illustrated in FIGS. 6 and 7. The photographic film which is a photosensitive web material is wound around a core 11 consisting of a core body 12 and a crosslinked foamed sheet 13.

Figure 8:
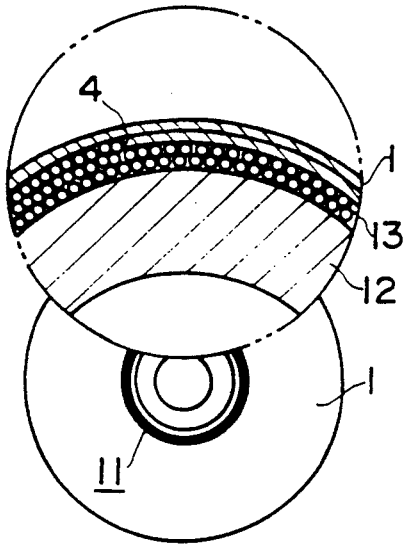
FIG. 8 is a front view with a partially enlarged section.

The core body 12 was made of brown paper composed of 30 wt. % of unbreached kraft paper and 70 wt. % waste corrugated board paper wound in spiral, and the thickness was 5.5 mm. The crosslinked foamed homopolyethylene resin produced by foaming LDPE resin having a density of 0.920 g/cm$^3$ at an expansion ratio of 30 times, and the thickness was 0.5 mm. The crosslinked foamed sheet 13 was wound around the core body 12 in a single fold in spiral. The photographic film 1 was a positive roll film 150 m in length of which the substrate 2 was a biaxially stretched polyester resin film about 170 μm is thickness rendered white opaque by blending $BaSO_4$, that was coated with a photographic emulsion layer. The base end of the photographic film was conventional, i.e. cut in parallel to the width direction perpendicular to the longitudinal direction of the film. The base end portion was not thinned. The base end was fixed to the crosslinked foamed sheet by using an adhesive tape, and then winding was started. During winding, the base end 4 sank into the crosslinked foamed sheet 13 to dissolve the difference in level, as shown in FIG. 8.

The roll was left at 35° C. for one week, and it was confirmed that no occurrence of physical marks around the base end portion. Pressure marks an sensitivity deviation did not occur, too. Flattening compressive strength was sufficient, and the roll form of the photographic film was excellent. Streaks were not formed. The core could readily be discriminated even under a safety light, and the photographic film was easily fixed to the core.

Figure 10:
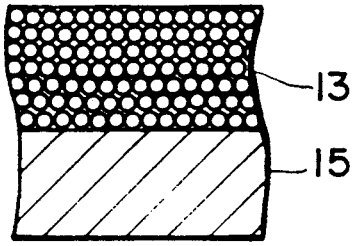
FIG. 10 and 11 are partial sectional views of crosslinked foamed sheets applicable to the invention.
Figure 11:
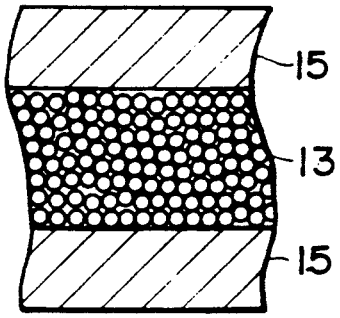
Figure 12:
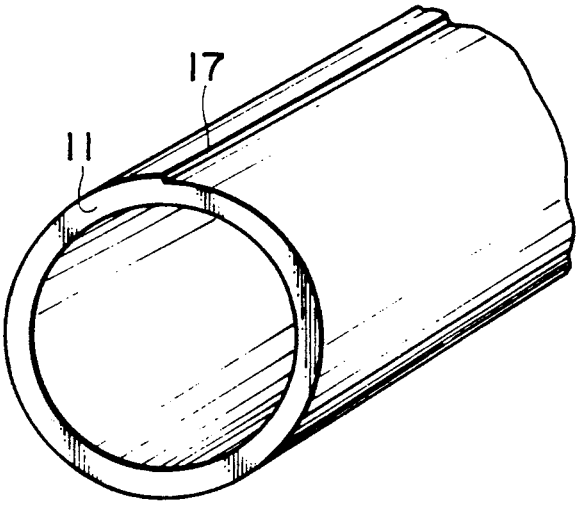
FIG. 12 is a partial perspective view of a conventional core.
Figure 13:
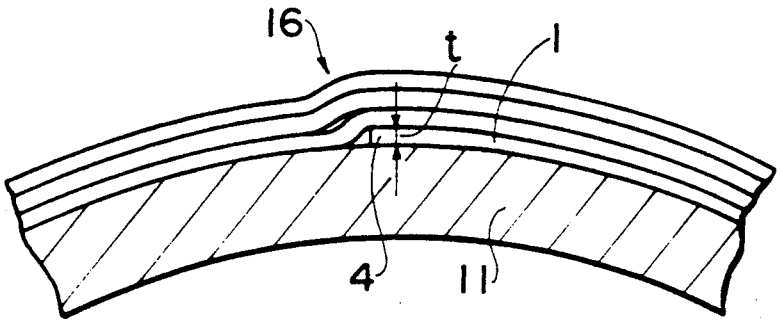
FIG. 13 is a partial sectional view illustrating a conventional wound state of a photosensitive web material.

Two other crosslinked foamed sheets are shown in FIGS. 10 and 11 where one or two thermoplastic resin layers 15,15 are laminated onto one or both sides of the crosslinked foamed sheet 13.

Example VIII

Another roll was prepared in the same manner as Example VII, except that the crosslinked foamed sheet was produced by foaming L-LDPE resin (ethylene-butene-1 copolymer resin) having a density of 0.921 g/cm$^3$ at an expansion ratio of 35 times, and the thickness was 1.0 mm.

By conducting the same evaluation tests as Example VII, better results were obtained than Example VII, and the number of folds where troubles occurred was reduced by half, i.e. one fold.

Example IX

Another roll was prepared in the same manner as Example VII, except that the crosslinked foamed sheet was produced by foaming EVA resin having a density of 0.940 g/cm$^3$ and a vinyl acetate comonomer content of 15 wt. % at an expansions ratio of 20 times, and the thickness of 0.5 mm, and that no adhesive tape was used.

By conducting the same evaluation tests as Example VII, almost the same good results were obtained. The core had a great friction resistance with the positive roll film, and the film could be wound without using an adhesive tape.

Example X

The core body was the same as Example VII. The crosslinked foamed sheet was produced by foaming a blend resin composed of 60 wt. % of the LDPE resin of Example VII and 40 wt. % of the L-LDPE resin of Example VIII at an expansion ratio of 30 times, and the thickness was 0.5 mm. The photographic film was a negative roll film 50 m in length of which the substrate was a biaxially stretched polyester resin film 100 μm in thickness, coated with a photographic emulsion layer for lithfilm.

By conducting the same evaluation tests as Examples VII, almost the same good results were obtained.

Example XI

Another roll was prepared in the same manner as Example VII, except that the base end portion of the photographic film was processed in the form shown in FIG. 2(*a*).

By conducting the same evaluation tests as Example VII, the physical marking troubles caused by the base end of the rolled photographic film were particularly improved.

Example XII

Another roll was prepared in the same manner as Example XI, except that a foamed polyethylene resin sheet ("Softron", Sekisui Chemical Co., Ltd.) 1 mm in thickness having an expansion ratio of 5 times was used instead of the crosslinked foamed sheet of Example XI.

By conducting the same evaluation tests as Example VII, various marking troubles and pressure mark troubles were sharply reduced compared with the conventional roll formed by using the conventional core and a rolled photographic negative film for printing of which the base end portion was cut in parallel to the width direction perpendicular to the longitudinal direction of the film. Besides, the troubles were reduced to one third in a practical level compared with the roll formed by using the core of Example 2 in Japanese Utility Model KOKOKU No. 2-24116 which is the same as employed in this example and the rolled photographic negative film for printing of which the base end portion was cut in parallel to the width direction perpendicular to the longitudinal direction of the film.

Example XIII

Figure 9:
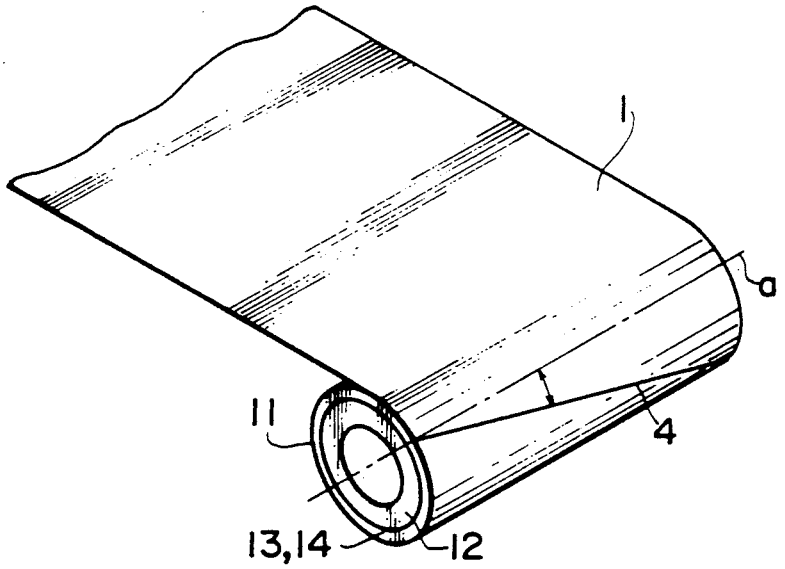
FIG. 9 is a perspective view illustrating a winding state of a photographic film in which the base end is obliquely cut in the width direction.

Another roll was prepared in the same manner as Example XI, except that the base end was obliquely cut in the width direction as shown in FIG. 4(*a*). The winding state is as shown in FIG. 9.

Upon conducting the same evaluation tests as Example VII, it was found that there were few marking troubles and pressure mark troubles similar to Example XI, and the part impossible for use was small. The roll form was excellent, and streaks did not occur at all.

Comparative I

The core body was made of kraft paper having a density of 0.75 g/cm$^3$ wound in spiral, and the thickness was 6.0 mm. Nonwoven fabric having a density of 0.32 g/cm$^3$ and an areal weight of about 130 g/cm$^3$ was used instead of the foamed sheet, and wound thereon in spiral.

The results of the same evaluation tests as Example VII are shown in Table 2.

Comparative II

The core body was the same as Example VIII. A foamed polyethylene sheet ("Softron", Sekisui Chemical Co., Ltd.) 1 mm in thickness having an expansion ratio of 5 times was used as the cushioning material, and wound around the core body in one fold.

The results of the same evaluation tests as Example VII are shown in Table 2.

Comparative III

This roll was the same as Comparative I, except that chipboard paper having a density of 0.5 g/cm$^3$ and a thickness of 1.0 mm was wound around the core body in one fold as the cushioning material.

The results of the same evaluation tests as Example VII are shown in Table 2.

Comparative IV

This roll was the same as Comparative I, except that kraft paper having a density of 0.75 g/cm$^3$ was wound around the core body in spiral.

The results of the same evaluation tests as Example VII are shown in Table 2.

Comparative V

The rolled film employed was a rolled photographic negative film 50 m in length composed of a biaxially stretched polyester resin film substrate 100 $\mu$m in thickness and a photographic emulsion layer for lithfilm coated thereon, and the others are the same as Conventional Example 2.

The results of the same evaluation tests as Example VII are shown in Table 2.

Comparative VI

This roll was the same as Comparative IV, except that the rolled film was the same as employed in Example XIII, and the base end was obliquely cut in the width direction as shown in FIG. 4(*a*).

The results of the same evaluation tests as Example VII are shown in Table 2.

TABLE 2

| | Example | | | | Comparative | | | | | | | | |
|---|---|---|---|---|---|---|---|---|---|---|---|---|---|
| | VII | VIII | IX | X | I | II | III | IV | V | VI | XI | XII | XIII |
| Core Surface Sheet | Crosslinked Foamed LDPE Sheet | Crosslinked Foamed L-LDPE Sheet | Crosslinked Foamed EVA Sheet | Crosslinked Foamed L-LDPE Sheet | Kraft Paper | Nonwoven Fabric | Foamed LDPE Sheet | Chipboard Paper | Foamed LDPE Sheet | Kraft Paper | Crosslinked Foamed LDPE Sheet | Foamed LDPE Sheet | Crosslinked Foamed LDPE Sheet |
| Kind Material | LDPE | L-LDPE | EVA | LDPE/ L-LDPE | Paper | Fabric | LDPE | Paper | LDPE | Paper | LDPE | LDPE | LDPE |
| Expansion times Ratio | 30 | 35 | 20 | 30 | — | — | 5.0 | — | 5.0 | 30 | 5.0 | 30 | |
| Density $g/cm^3$ | — | — | — | — | 0.75 | 0.3 | — | 0.5 | — | 0.75 | — | — | — |
| Thickness mm | 0.5 | 1.0 | 0.5 | 6.0 | 6.0 | 0.4 | 1.0 | 1.0 | 1.0 | 6.0 | 0.5 | 1.0 | 0.5 |
| Substrate for Roll Film Kind | Biaxially Stretched Polyester Film | Biaxially Stretched Polyester Film | Biaxially Stretched Polyester Film | Biaxially Stretched Polyester Film | Biaxially Stretched Polyester Film | Biaxially Stretched Polyester Film | Biaxially Stretched Polyester Film | Biaxially Stretched Polyester Film | Biaxially Stretched Polyester Film | Biaxially Stretched Polyester Film | Biaxially Stretched Polyester Film | Biaxially Stretched Polyester Film | Biaxially Stretched Polyester Film |
| Thickness μm | 170 | 170 | 170 | 100 | 170 | 170 | 170 | 170 | 100 | 100 | 100 | 100 | 100 |
| Form of Winging Base End | FIG. 1 (dashed line) | FIG. 1 (dashed line) | FIG. 1 (dashed line) | FIG.1 (dashed line) | FIG. 1 (dashed line) | FIG. 1 (dashed line) | FIG. 1 (dashed line) | FIG. 1 (dashed line) | FIG. 1 (dashed line) | FIG. 4(a) | FIG. 2(a) | FIG. 2(a) | FIG. 4(a) |
| Photographic Emulsion | Positive | Positive | Positive | Negative | Positive | Positive | Positive | Positive | Negative | Negative | Negative | Negative | Negative |
| Marking by Core Surface | A | A | B | B | F | E | D | F | E | F | A | B | A |
| Marking by Winding End | A | A | B | B | F | F | D | F | E | F | A | B | A |
| Pressure Mark by Winding End | A | A | A | A | E | E | C | E | D | E | A | A | A |
| Tape-Form Marking | A | A | B | B | F | F | E | F | E | F | A | B | B |
| Streaks | A | A | A | A | D | C | C | D | C | E | A | A | A |

We claim:

1. A core for a rolled photographic film which comprises a core body and a crosslinked foamed sheet having an expansion ratio of 18 to 45 times and a thickness of 0.2 to 2.0 mm which contains more than 50 wt. % in the sum of one or more members selected form the group consisting of polyethylene resin having a density of less than 0.930 g/cm$^3$, ethylenevinyl acetate copolymer resin having a comonomer content of less than 25 wt. % and ethylene-ethyl acrylate copolymer resin having a comonomer content of less than 25 wt. % is disposed on the surface of the core body.

2. The core of claim 1 wherein said crosslinked foamed sheet contains more than 50 wt. % of the polyethylene resin.

3. The core of claim 2 wherein said polyethylene resin is linear low density polyethylene resin or a blend of homopolyethylene resin and linear low density polyethylene resin.

4. The core of claim 2 wherein the density of the polyethylene resin is 0.910 to 0.925 g/cm$^3$.

5. The core of claim 1 wherein said crosslinked foamed sheet contains more than 50 wt. % of ethylene-vinyl acetate copolymer resin.

6. The core of claim 1 wherein said crosslinked foamed sheet contains more than 50 wt. % of ethylene-ethyl acrylate copolymer resin.

7. The core of claim 1 wherein said crosslinked foamed sheet is foamed without using heat-decomposable blowing agent of which a principal component is an ammonium compound, a formalin compound or a sulfur compound.

8. A roll of a photographic film which comprises the core of claim 1 and a rolled photographic film of which the substrate is made of plastic having a heat resistance of more than 250° F. and a strength of more than 7,000 psi.

9. A roll of photographic film which comprises a core body, cushioning material which is a member selected form the group consisting of paper, synthetic paper and nonwoven fabric having a density of less than 0.5 g/cm$^3$, and foamed polyolefin sheet having an expansion ratio of 18 to 45 times disposed on the surface of the core body, and a rolled photographic film having an upper face, a reverse face and first and second sides, the film further having a base end portion that is gradually thinned toward the base end wound around the cushioning material wherein the angle $\alpha$ between the reverse face and the oblique face is 20 to 50 degrees.

10. The roll of claim 9 wherein the foamed polyolefin sheet comprises a crosslinked polyolefin resin containing more than 50 wt. % of at least one of polyethylene resin having a density of less than 0.930 g/cm$^3$, EVA resin having a comonomer content of less than 25 wt. % and EEA resin having a comonomer content of less than 25 wt. %.

11. A roll of a photographic film which comprises a core body, a cushioning material which is a member selected from the group consisting of paper, synthetic paper and nonwoven fabric having a density of less than 0.5 g/cm$^3$, and foamed polyolefin sheet having an expansion ratio of 18 to 45 times disposed on the surface of the core body, and a rolled photographic film of which the length of the base end is longer than the width of the photographic film, said base end being formed by obliquely cutting the film so as to form an angle $\beta$ between a side of the film and the base end of 30 to 80 degrees.

12. The roll of claim 11 wherein the foamed polyolefin sheet comprises a crosslinked polyolefin resin containing more than 50 wt. % of at least one of polyethylene resin having a density of less than 0.930 g/cm$^3$, EVA resin having a comonomer content of less than 25 wt. % and EEA resin having a comonomer content of less than 25 wt. %.

* * * * *